US009278782B2

(12) United States Patent
Fjelland

(10) Patent No.: US 9,278,782 B2
(45) Date of Patent: Mar. 8, 2016

(54) HANDLE ASSEMBLY FOR A CONTAINER

(75) Inventor: Douglas J. Fjelland, Medford, OR (US)

(73) Assignee: Becklin Holdings, Inc., Reno, NV (US)

( * ) Notice: Subject to any disclaimer, the term of this patent is extended or adjusted under 35 U.S.C. 154(b) by 186 days.

(21) Appl. No.: 12/859,994

(22) Filed: Aug. 20, 2010

(65) Prior Publication Data

US 2012/0043342 A1 Feb. 23, 2012

(51) Int. Cl.
*H01M 2/10* (2006.01)
*B65D 25/28* (2006.01)

(52) U.S. Cl.
CPC ..... *B65D 25/2841* (2013.01)

(58) Field of Classification Search
USPC ..... 16/408–411, 445, 114.1, 405, 438, 436, 16/439, DIG. 15, 423–424; 220/759–776; 294/167, 169, 30
See application file for complete search history.

(56) References Cited

U.S. PATENT DOCUMENTS

| | | | | |
|---|---|---|---|---|
| 4,655,360 | A | 4/1987 | Juhanson | |
| 5,042,676 | A * | 8/1991 | Gohlke | 220/759 |
| 5,203,494 | A | 4/1993 | Blomfield | |
| 5,461,755 | A * | 10/1995 | Hardigg et al. | 16/438 |
| 5,667,265 | A * | 9/1997 | Gebhard | 294/27.1 |
| 5,769,230 | A | 6/1998 | Koefelda | |
| 6,085,467 | A | 7/2000 | Packrall et al. | |
| 6,186,345 | B1 | 2/2001 | Robertson | |
| 6,230,925 | B1 * | 5/2001 | Hardigg et al. | 220/761 |
| 6,237,758 | B1 | 5/2001 | Hsu | |
| 6,317,930 | B1 * | 11/2001 | Hung | 16/430 |
| RE37,518 | E | 1/2002 | Hardigg et al. | |
| 6,397,436 | B1 * | 6/2002 | Wang | 16/445 |
| 6,457,599 | B1 | 10/2002 | Apps et al. | |
| 7,165,477 | B2 * | 1/2007 | Lyne, Jr. | 81/15.8 |
| 7,537,119 | B2 | 5/2009 | Becklin | |
| 2001/0027596 | A1 * | 10/2001 | Lyne, Jr. | 29/407.01 |
| 2008/0264820 | A1 | 10/2008 | Becklin | |
| 2010/0084119 | A1 | 4/2010 | Becklin | |
| 2013/0088022 | A1 * | 4/2013 | Collado et al. | 292/336.3 |

* cited by examiner

*Primary Examiner* — Victor Batson
*Assistant Examiner* — Matthew Sullivan
(74) *Attorney, Agent, or Firm* — Lowe Graham Jones PLLC

(57) ABSTRACT

A handle assembly for a container includes a baseplate and a handle portion. A post extends from an arm of the handle portion and is configured to allow the baseplate to be snapped onto the post. In turn, the baseplate may be fastened or otherwise attached to the container. When lifting the container, the handle is rotated from a stored position and mechanically halted in a lifting position with interlocking complementary stops coupled to the handle portion and baseplate, respectively. In one embodiment, the stops include complementarily angled surfaces that are placed in interlocking bearing contact when the handle portion is in the lifting position. A biasing member coupled to the handle portion and engaged with the baseplate biases the handle portion toward the stored position.

19 Claims, 11 Drawing Sheets

HANDLE ASSEMBLY FOR A CONTAINER

FIELD OF THE INVENTION

This invention relates to a handle assembly for a container, such as a stackable container, and more specifically to a low profile handle assembly rotatable to selected positions relative to the container.

BACKGROUND OF THE INVENTION

Various types of containers, which may take the form of transit containers, rack-mount containers, tote containers or another type of container, are often utilized to receive and support delicate cargo such as, but not limited to, electronic, computer, optical and other types of equipment. These containers are often used in military and commercial environments and may be handled by persons, loading equipment, or both during transit and at other times. At least some of these containers have been designed to be stackable, and thus they include stacking elements or features arranged in a desired pattern. However, many of these containers may be of different types, sizes, models and versions, and thus have different stacking patterns that either do not permit the containers to be stacked together or that reduce the effectiveness, stability and/or efficiency of the containers when they are stacked together. By way of example, one company that manufactures containers having different stacking patterns is ECS Composites, Inc. out of Grants Pass, Oreg.

A variety of containers with stackability patterns include, but are not necessarily limited to, the following containers described in U.S. Pat. No. 6,457,599 to Apps et al.; U.S. Pat. No. 6,237,758 to Hsu; U.S. Pat. No. 6,186,345 to Robertson; U.S. Pat. No. 6,085,467 to Packrall et al.; U.S. Pat. No. 5,769,230 to Koefelda; U.S. Pat. No. 5,203,494 to Blomfield; and U.S. Pat. No. 4,655,360 to Juhanson.

SUMMARY OF THE INVENTION

Containers, such as transit containers, rack-mount containers, tote containers or other types of containers must often be moved or re-stacked. In so doing and depending on the weight of the contents within the container, the static and dynamic loads through the handles may be rather significant. Existing handles are multi-piece assemblies that may be difficult to replace and re-assemble in the field. The handles of the present invention are lightweight, corrosion resistant, impact resistant, may be sufficiently assembled before being fastened to the container, and are configured to provide a structurally robust load path where load is transferred from the container, into cooperating stops, and then into the handle such that the container may be moved or re-stacked. This load transfer happens through the implementation of a low-profile design that takes advantage of interlocking stops located inboard from the handle. The stops provide rigidity while in a lifting position and have a low-profile when the handle is in a stored position.

In one embodiment of the present invention a handle assembly for a container includes a handle portion having a grippable member coupled to an arm that respectively extends from the grippable member, the handle portion movable from a stored position to a lifting position; a post extending from the arm, the post having a first section positioned adjacent to the arm and a second section extending from the first section; an angled stop coupled to the inboard surface of the arm portion; a biasing member received on the second section of the post, the member having a first end portion engageable with the baseplate and a second end portion coupled to, or retained on, the post; and a baseplate releasably connectable to the handle, the baseplate having a baseplate stop arranged to engage with the arm stop when the handle portion is rotated to the lifting position.

In another embodiment of the present invention, a method for lifting a container includes the steps of (1) moving a handle portion of a handle assembly from a stored position to a lifting position; (2) mechanically stopping the handle portion in the lifting position by engagement of interlocking complementarily angled stops in which one stop is coupled to the inboard surface of an arm of the handle portion and another stop is coupled to a baseplate of the handle assembly; and (3) biasing the handle portion toward a stored position.

In yet another embodiment of the present invention, a container includes a container shell having integral overhanging tabs; and a handle assembly having a baseplate and a handle portion, the baseplate having an upper portion and a lower portion, the upper portion configured to slide behind and be retained by the tabs, the lower portion attachable to the container shell with a plurality of fasteners, the handle portion having a grippable member coupled to an arm that respectively extends from the grippable member, the handle portion movable from a stored position to a lifting position.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

The containers may include a recess to protect attached hardware such as latches and handles. The recess is formed by protruding guards, ribs or other structural features. In an effort to design a handle that will work in as many applications as possible, where limitations exist such as the depth of the recess or the space available on a mounting surface, it is desirable to produce a robust handle that is low-profile with respect to both its protruding distance from the surface to which it is mounted and also with respect to total surface area required on the mounting surface. The smaller the handle, the more adaptable it is to multiple applications. When the handle is to be mounted on the vertical side-walls of the container, it is also desirable that the handle stop at approximately ninety degrees relative to the side-wall of the container when in a lifting or operational position. This stop is to provide a solid grip for lifting the container while not crushing the lifter's fingers between the grip and the side-wall. The handle assembly described herein utilizes interlocking stopping features that not only produce a robust load path for the handle, but also minimize the overall profile of the assembly.

Figure 1:
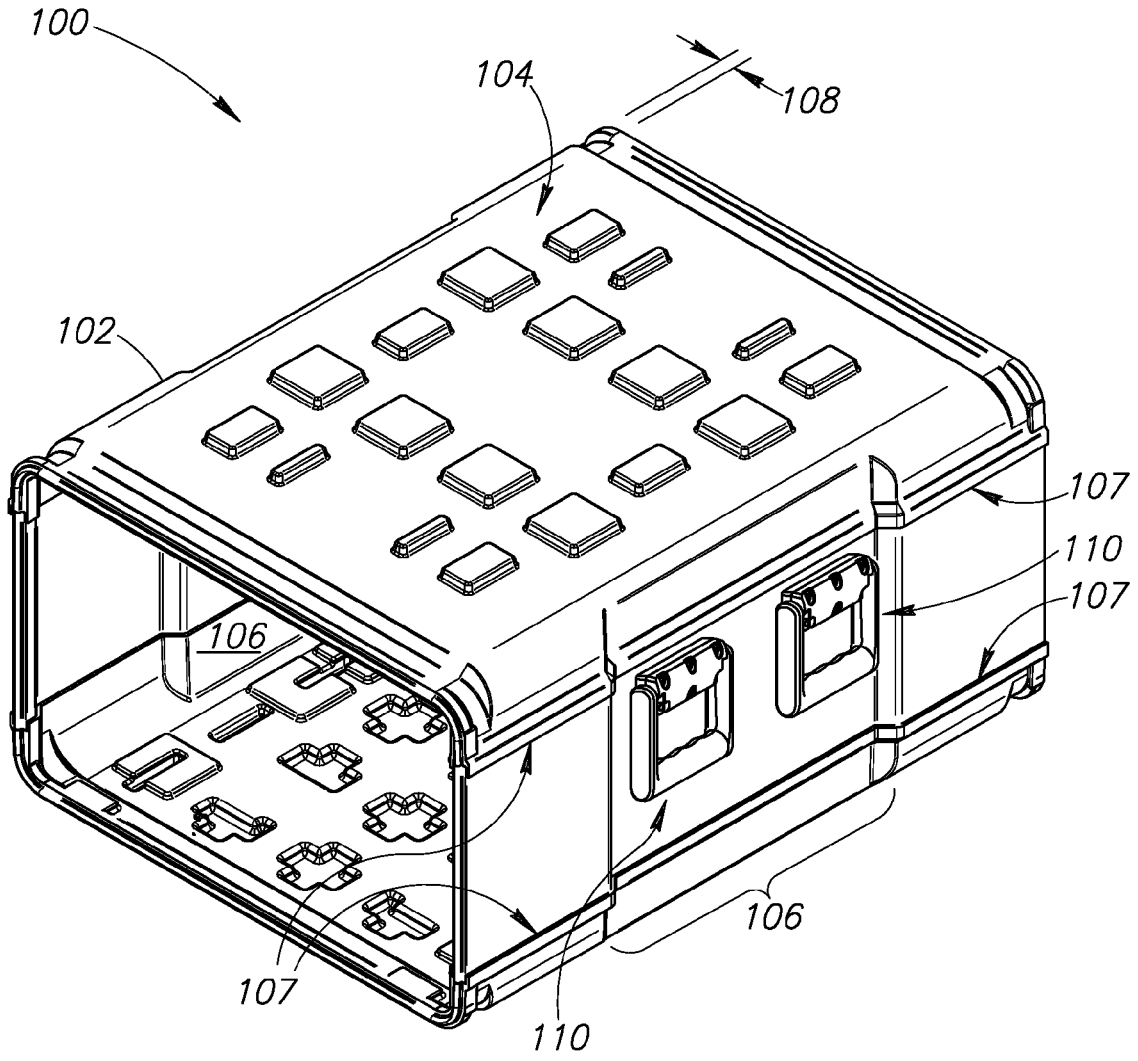
FIG. 1 is a perspective view of a stackable container having two handle assemblies according to an embodiment of the present invention.

FIG. 1 shows a container 100, which may take the form of a stackable container, having a container shell 102, a stacking pattern 104 and one or more handle assemblies 110. The container shell 102 includes a recessed or inset surface 106 set back from a side wall rib feature 107 of the shell 102. The recessed surface 106 may be set back from the side wall rib feature 107 by a desired distance 108, to protect the handle assembly within the outer envelope of the case. The low-profile features of the handle assemblies 110 are designed so that when in a stored position, the handle assemblies 110 do not extend beyond the outer side wall rib features 107. The handle assemblies 110 are fastened or otherwise attached to the recessed surface 106 of the shell 102.

Figure 2A:
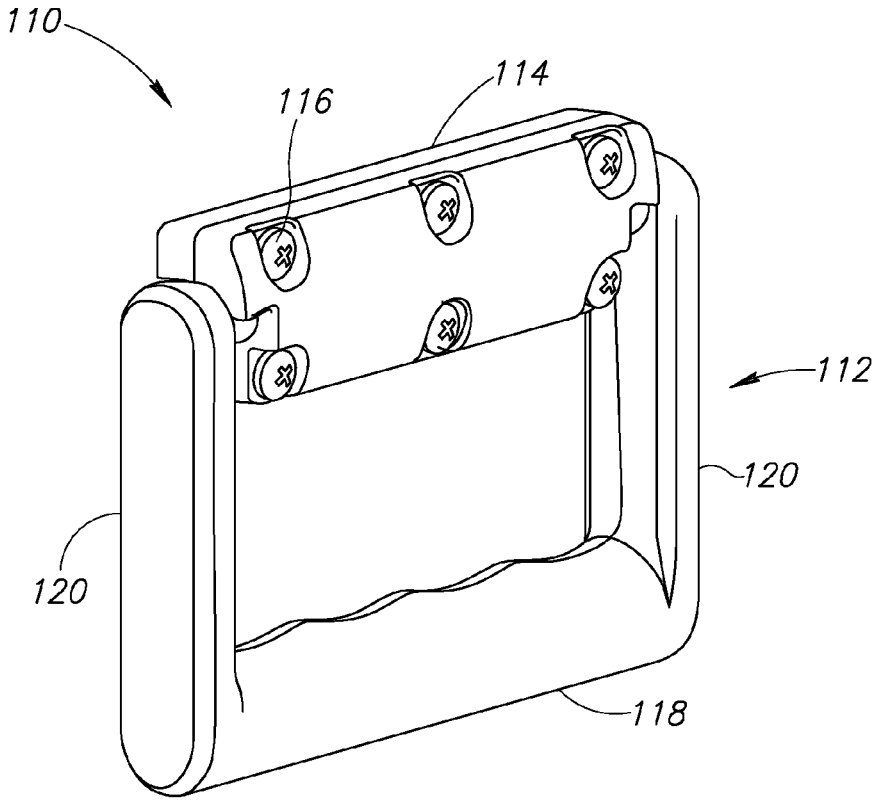
FIG. 2A is a perspective view of one of the handles from FIG. 1 in a stored configuration according to an embodiment of the present invention.
Figure 2B:
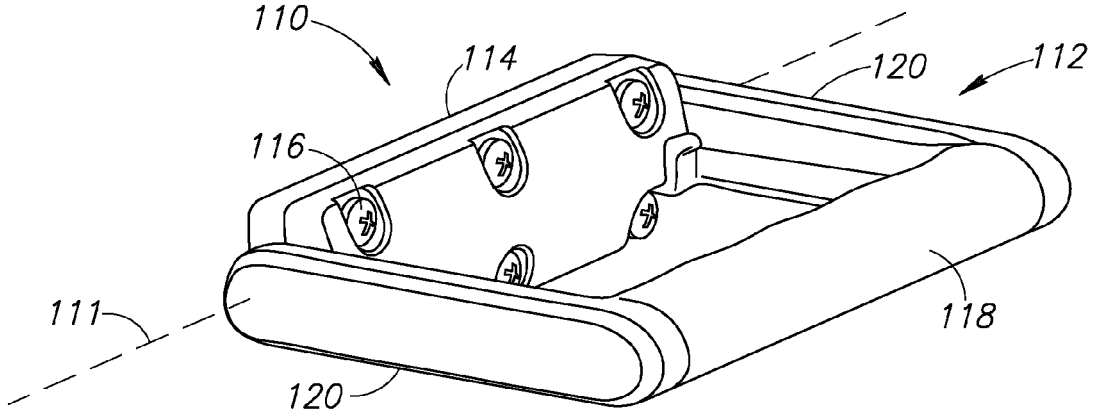
FIG. 2B is a perspective view one of the handles from FIG. 1 in a lifting configuration according to an embodiment of the present invention.

FIGS. 2A and 2B show the handle assembly 110 in the stored position (FIG. 2A) and then rotated to a lifting position (FIG. 2B) about an axis 111. The handle assembly 110 includes a handle portion 112 releasably coupled to a baseplate 114, which as noted above may be fastened to the container 100 with fasteners 116. The handle assembly 110 includes a grippable member 118 coupled to arms 120 that respectively extend from each side of the grippable member 118. In one embodiment, the grippable member 118 is fixed to or integrally formed with the arms 120. In another embodiment, the grippable member 118 may be pin-connected to the arms 120 such that the grippable member 118 rotates relative to the arms 120.

Figure 3:
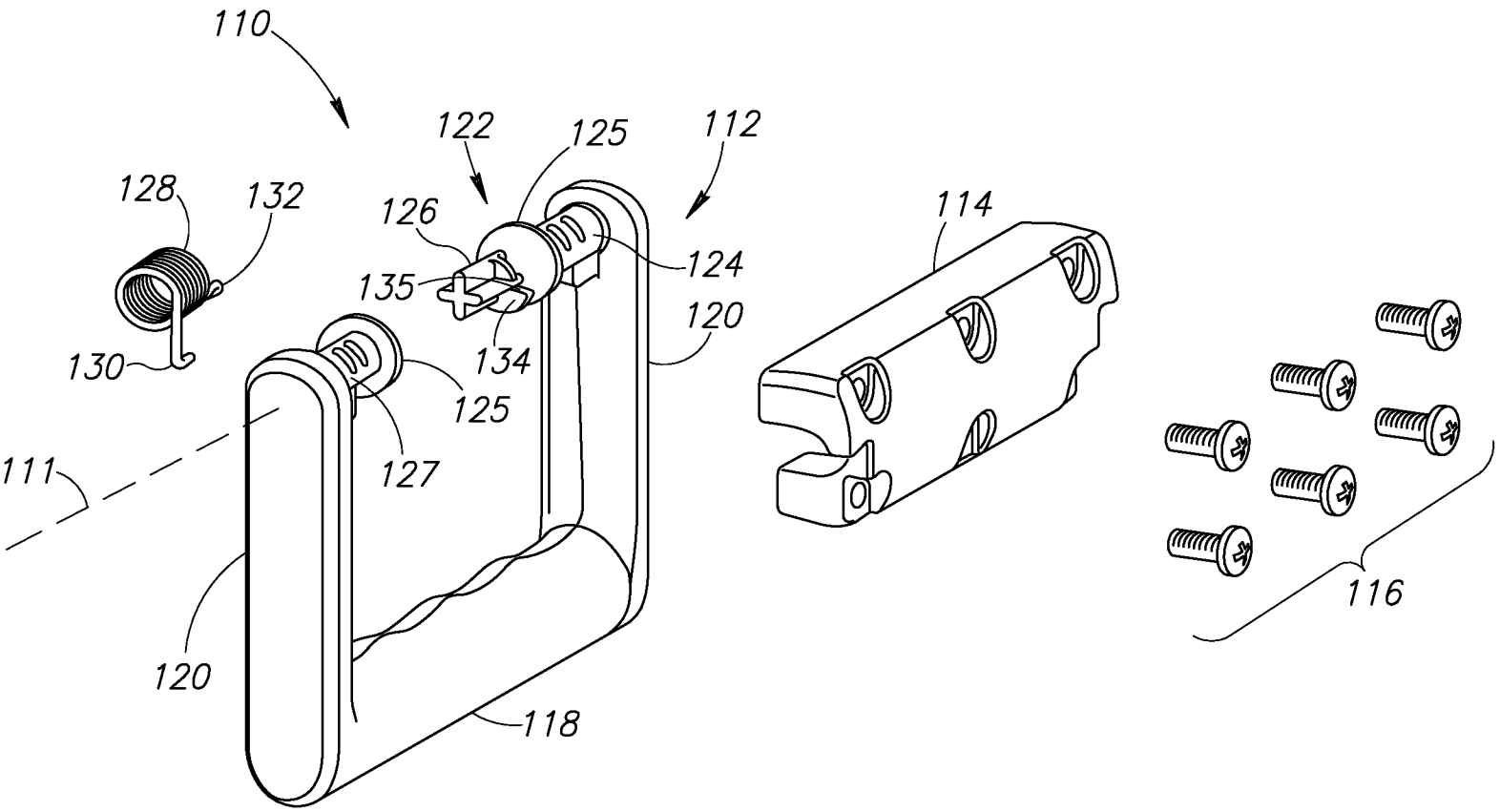
FIG. 3 is an exploded perspective view of one of the handles from FIG. 1 according to an embodiment of the present invention.

FIG. 3 shows an exploded view of the handle assembly 110 with particular attention to a first post 122 extending from one of the arms 120. The first post 122 includes an outer post portion 124 adjacent the arm 120 and an inner post portion 126 extending inward from the outer portion 124. A flange 125 may delineate the outer and inner portions 124, 126. In the illustrated embodiment, the first post 122, and more specifically the outer post portion 124 defines the axis 111 about which the handle assembly 100 rotates when being moved to and from the stored position and lifting position. In addition, the handle assembly 110 includes a second post 127, which may be structurally and functionally equivalent to the outer post portion 124 of the first post and may also include a flange 125 that limits the axial movement of the posts and arms.

A biasing member 128 is received onto the inner post portion 126 and includes a first end 130 and a second end 132. In a preferred embodiment, the biasing member may take the form of a torsional spring, however it is appreciated that other types of springs and/or resilient mechanisms may be employed, such as different types of springs to include, but not limited to, a leaf spring, a Belleville spring, cams, cantilevered beam devices, tabs that bend when the handle is lifted, etc. One purpose of the biasing member 128 is to provide a biasing force for maintaining the handle assembly 110 in the stored position unless that biasing force is overcome by a person lifting the handle assembly 110. Thus, when the container is stored, stacked, or otherwise in a static condition, the biasing member 128 maintains the handle assembly 110 in the stored position so it does not interfere with other containers or other items adjacent the container 100 (FIG. 1). Advantageously, the biasing force of the member 128 helps to prevent damage to the handle assembly 110.

Figure 4A:
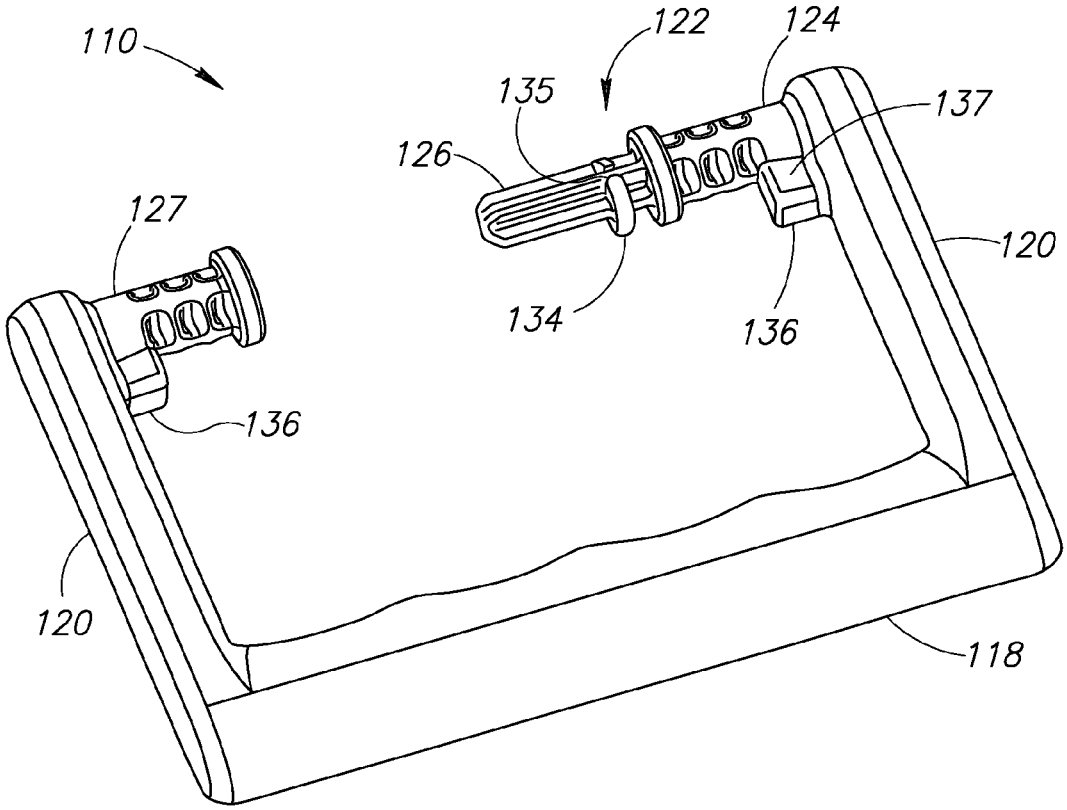
FIG. 4A is a perspective view of one of the handles from FIG. 1 without the baseplate according to an embodiment of the present invention.
Figure 4B:
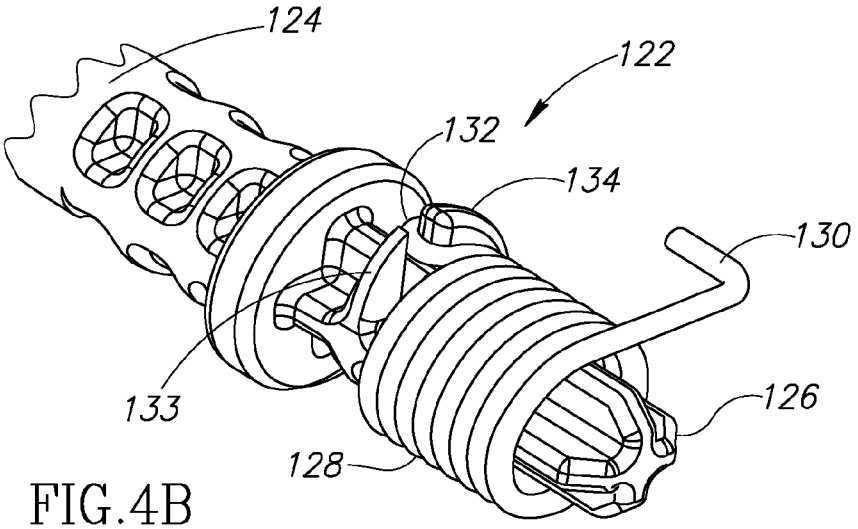
FIG. 4B is a partial, perspective view of the post of the handle from FIG. 4A showing a biasing member received on the post according to an embodiment of the present invention.

FIGS. 4A and 4B show the handle assembly 110, and particularly shows a coupling flange or stop 134 that cooperates with the second end 132 of the biasing member 128 (best illustrated in FIG. 4B). The second end 132 may take the form of a hook or curve configured to seat in a groove 135 between the stop 134, and the retaining ramp 133. The stop 134, in turn, may be sized to have a snug or friction fit with the second end 132 of the biasing member 128. Preferably, the retaining ramp 133 is sized so that when the spring 128 is rotated on the inner post section 126, the second end 132 engages the retaining ramp 133. The interference condition combined with the wedge action of the ramp 133 flexes the second end 132 of the biasing member 128 over the tip of the ramp 133 and into the groove 135. The retaining side of the ramp 133 is not wedged so the second end 132 of the spring must be intentionally flexed to remove it from the groove 135. This fit may advantageously keep the spring 128 retained on the post 122 during assembly or replacement of the handle assembly 110. When the handle assembly 110 is moved to the lifting position, the biasing member 128 absorbs this kinetic energy because the spring coils wind tighter since the second end 132 is coupled to the groove 135 while the first end 130 engages the baseplate 114.

Figure 5A:
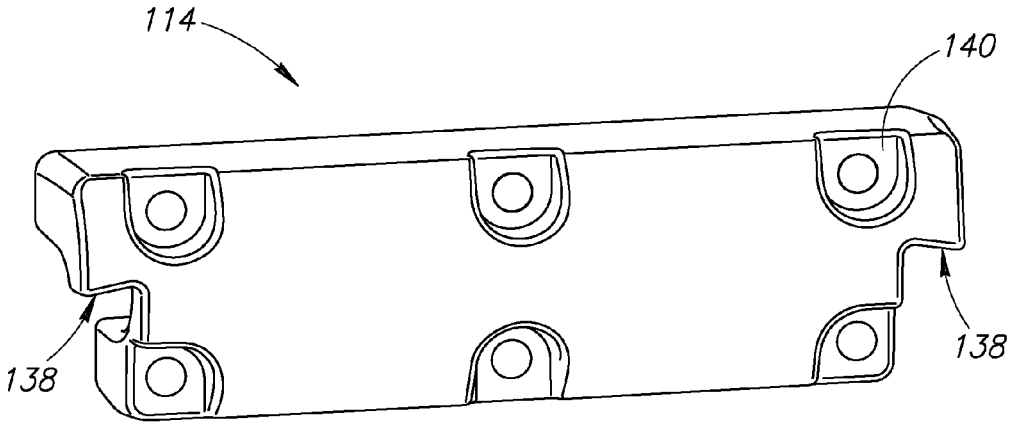
FIG. 5A is a front, elevational view of the baseplate from FIG. 2A without the handles attached thereto.
Figure 5B:
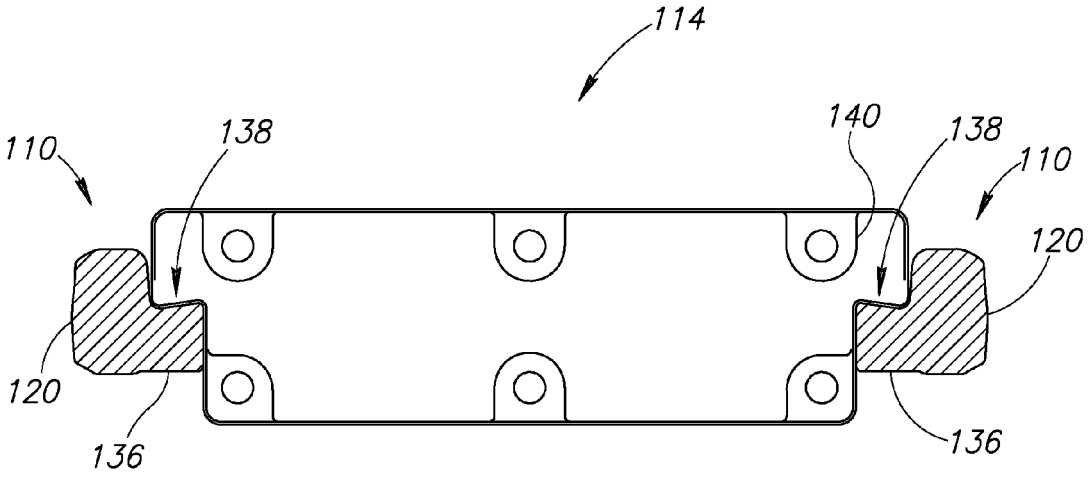
FIG. 5B is a front elevational, partial cross-sectional view of the baseplate from FIG. 2A with the handles in cross section and in the lifting configuration according to an embodiment of the present invention.

Still referring to FIG. 4A and also now referring to FIGS. 5A and 5B, the handle assembly 110 includes handle stop features 136 that complementarily cooperate and interlock with baseplate stop features 138. In the illustrated embodiment, the handle stop features 136 have an angled surface 137 relative to the sidewall of the arm and substantially perpendicular to the container wall when in the lifting position that complementarily engages and interlock with the angled, baseplate stop features 138. One purpose of these interlocking complementary surfaces is to provide a structurally robust load path that stiffens and strengthens the arms 120 at or near the handle stop features 136. In turn, the engagement of these stops 136, 138 may evenly distribute handle loads and reduce flexure of the arms 120 and/or baseplate 114.

Another purpose of the configuration of the stops is that by angling the contact surface and having the stops inboard from the arms, the stops interlock and have a rigid shape to that they can function as a more robust stopping mechanism with higher stiffness than a "cantilevered straight beam" stopping feature. This robust stopping mechanism can be accomplished without the need for a tall baseplate, or a thick handle to increase the moment arm for the stops. Further purpose for the stop configuration is that the interlocking nature of the angled contact surfaces prevents the ends of the arms from spreading away from the baseplate when the stops are loaded. If a cantilevered straight beam stop flexes upon loading, the deflection of the grip portion is compounded by two factors: (1) the deflection of the stop alone allows additional rotation of the handle; and (2) the deflected stop creates a wedge and when the arms of the handle "spread" apart, the contact of the stops move up the wedge, allowing even more rotation.

FIGS. 5A and 5B further show that the baseplate 114 may include recessed pockets 140 for receiving the fasteners 116 (FIG. 3). FIG. 5B shows cooperating interlocking surfaces of the stops angled with respect to the sidewall of the arm and substantially perpendicular to the container wall.

Figure 6:
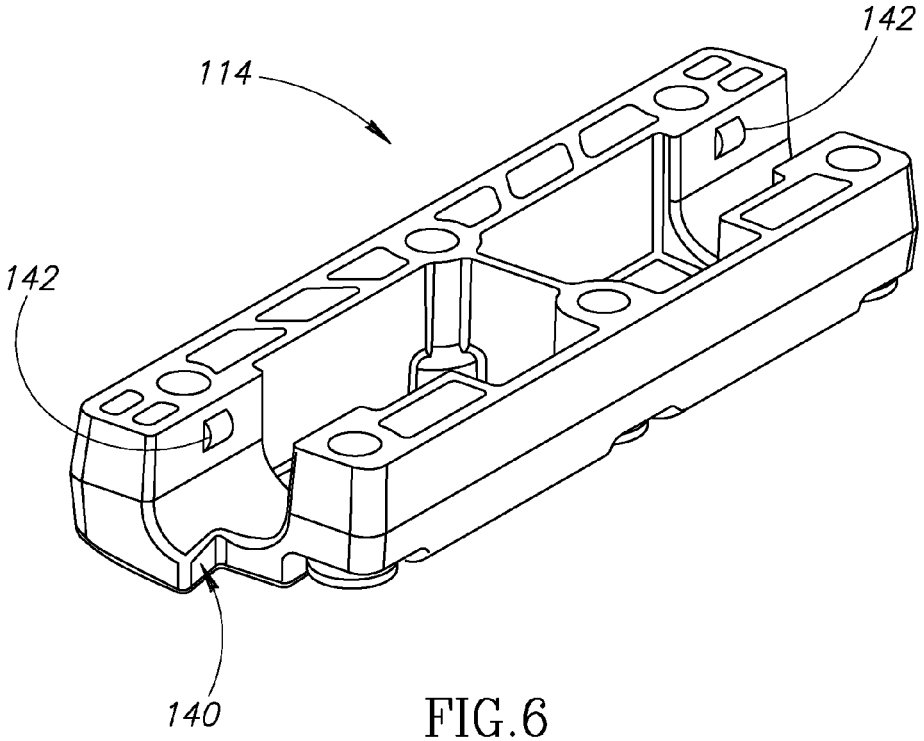
FIG. 6 is a bottom, rear perspective view of the baseplate from FIG. 5A according to an embodiment of the present invention.

FIG. 6 shows the baseplate 114 having retention protuberances 142, which may take the form of arcuate-shaped tabs, arranged to engage the post portions 124, 127 (FIG. 4A). The retention tabs permits the post portions 124, 127 to be snapped into the baseplate 114 for intermediate assembly so that parts of the handle assembly 110 will stay together while it is being mounted to the container 100 (FIG. 1), or while it is being stored for future use or being shipped for field repair or upgrade applications.

Figure 7:
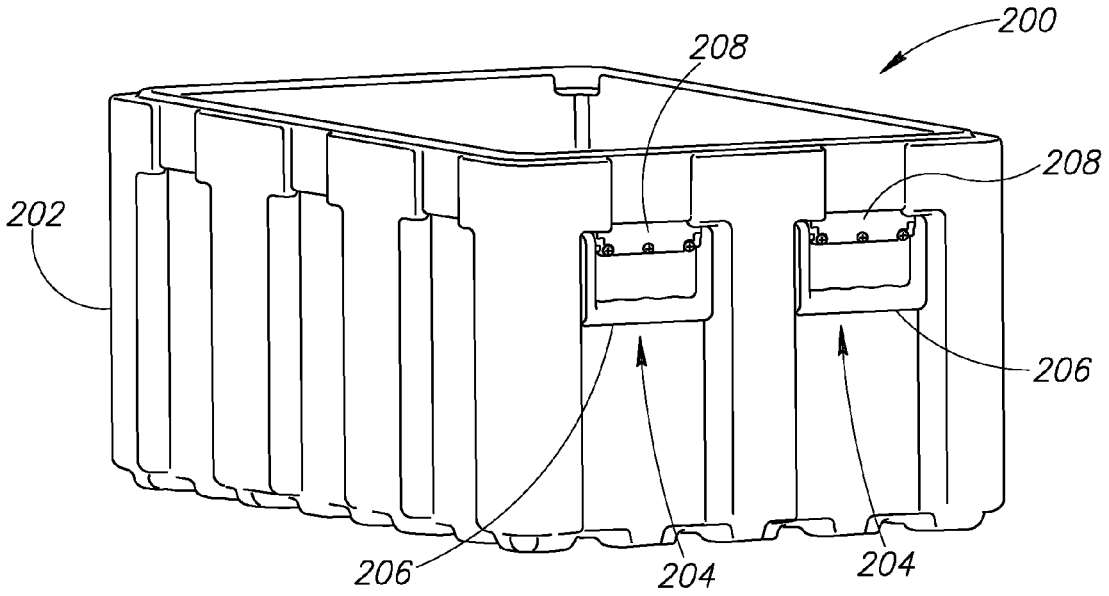
FIG. 7 is a perspective view of a container having integral retainer tabs for a handle assembly according to an embodiment of the present invention.
Figure 8A:
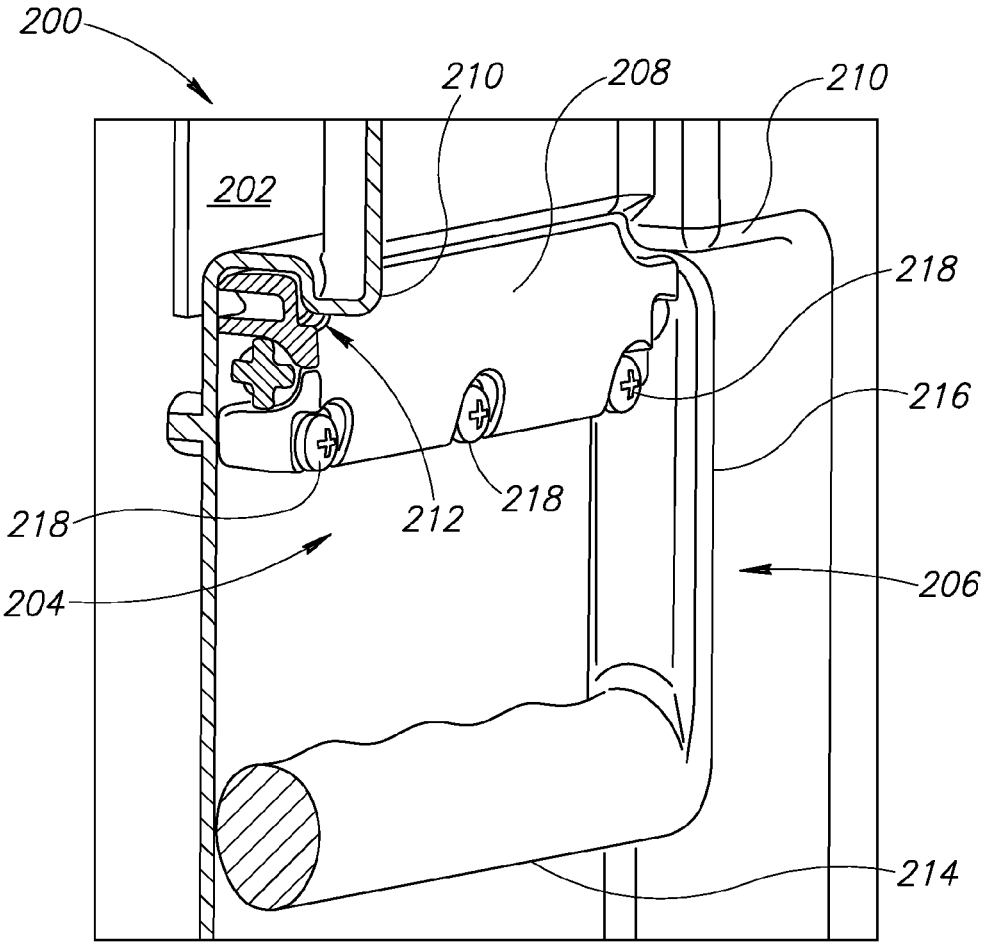
FIGS. 8A and 8B are perspective cross-sectional views of a handle assembly according to another embodiment of the present invention in which the handle assembly is in a stored position and lifting position, respectively.
Figure 8B:
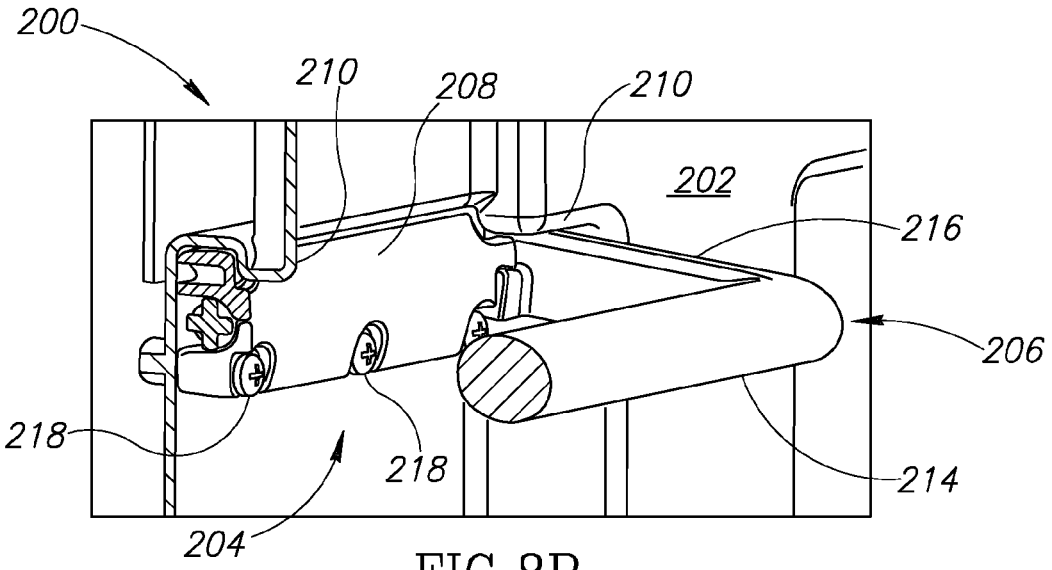
Figure 9:
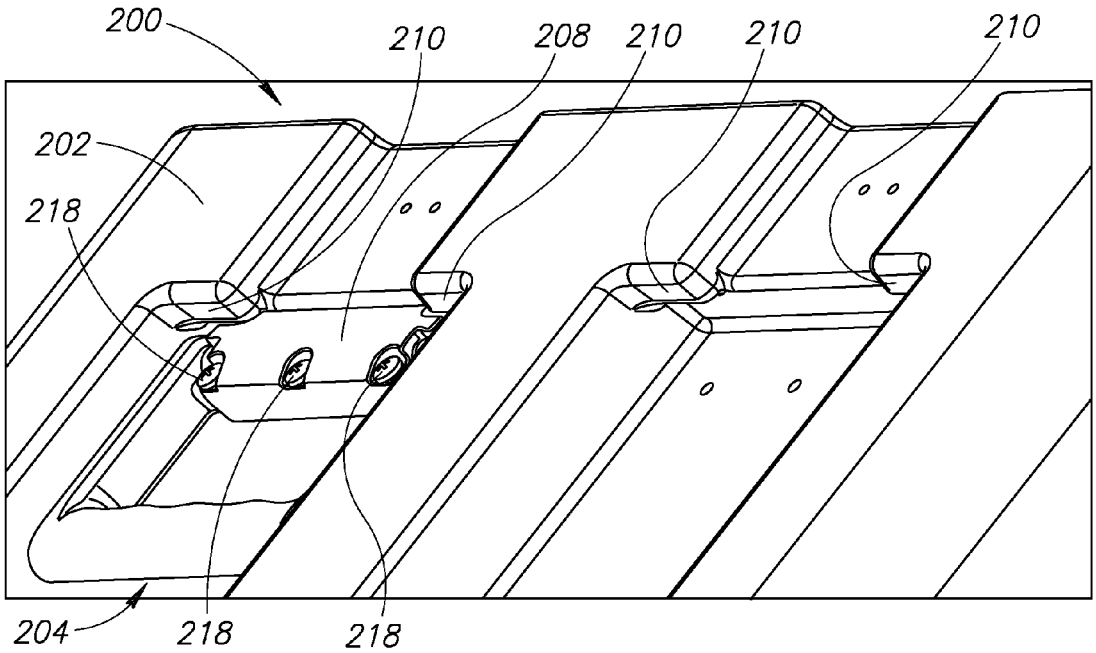
FIG. 9 is a detailed, perspective view of the container of FIG. 7 with one handle assembly removed for purposes of clarity.

FIG. 7 shows a container system 200 having a container shell 202 with handle assemblies 204 attached thereto. The handle assembly 204 includes a handle portion 206 coupled to a baseplate 208. As best shown in FIGS. 8A, 8B and 9, the container shell 202 includes integral, overhanging and undercut retainer tabs 210 that cooperate with recessed portions 212 formed in the baseplate 208 to frictionally and capturably engage and retain the baseplate. FIG. 8A shows a cross-sectional view of the handle portion 206 having one grippable member 214 extending from an arm 216 of the handle portion. In one embodiment, the tabs 210 are integrally molded with the container shell 202 while the recessed portions 212 are integrally molded with the baseplate 208. Advantageously, the interaction of the tabs 210 with the recessed portions 212 of the baseplate may provide a robust connection method for the handle assembly 204.

The baseplate 208 is mounted with fasteners 218 along a bottom portion of the baseplate. The illustrated embodiment shows three fasteners 218, but it is appreciated that any number of fasteners may be employed depending on the size or configuration of the handle assembly 204. The baseplate 208 may include slotted mounting holes to accommodate variances in mounting holes provided in the shell 202, which may be configured to receive threaded inserts.

The overhanging tabs 210 may function as positive stops for the arm 216 of the handle portion 206 in conjunction with the stopping features described above. This dual stopping configuration may advantageously result in a rigid stop that withstands high loads with low deflection.

Figure 10:
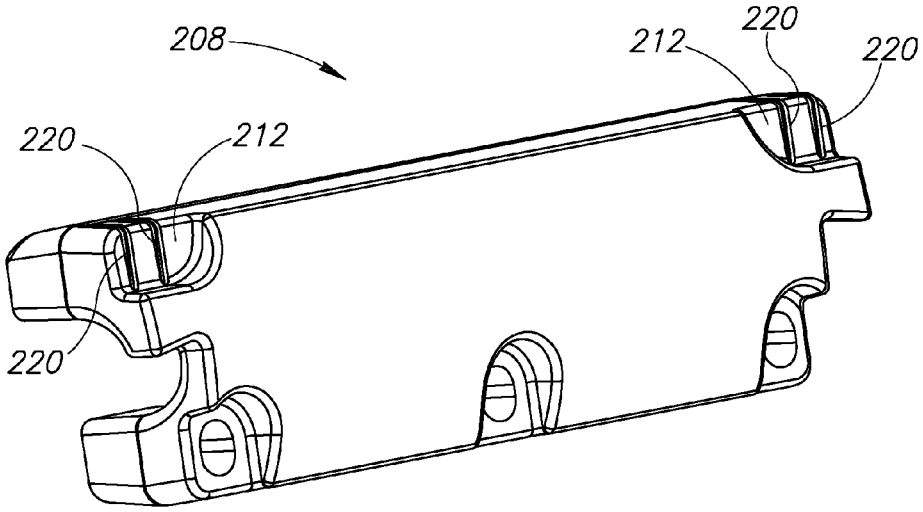
FIG. 10 is a perspective view of a baseplate for a handle assembly according to another embodiment of the present invention.
Figure 11:
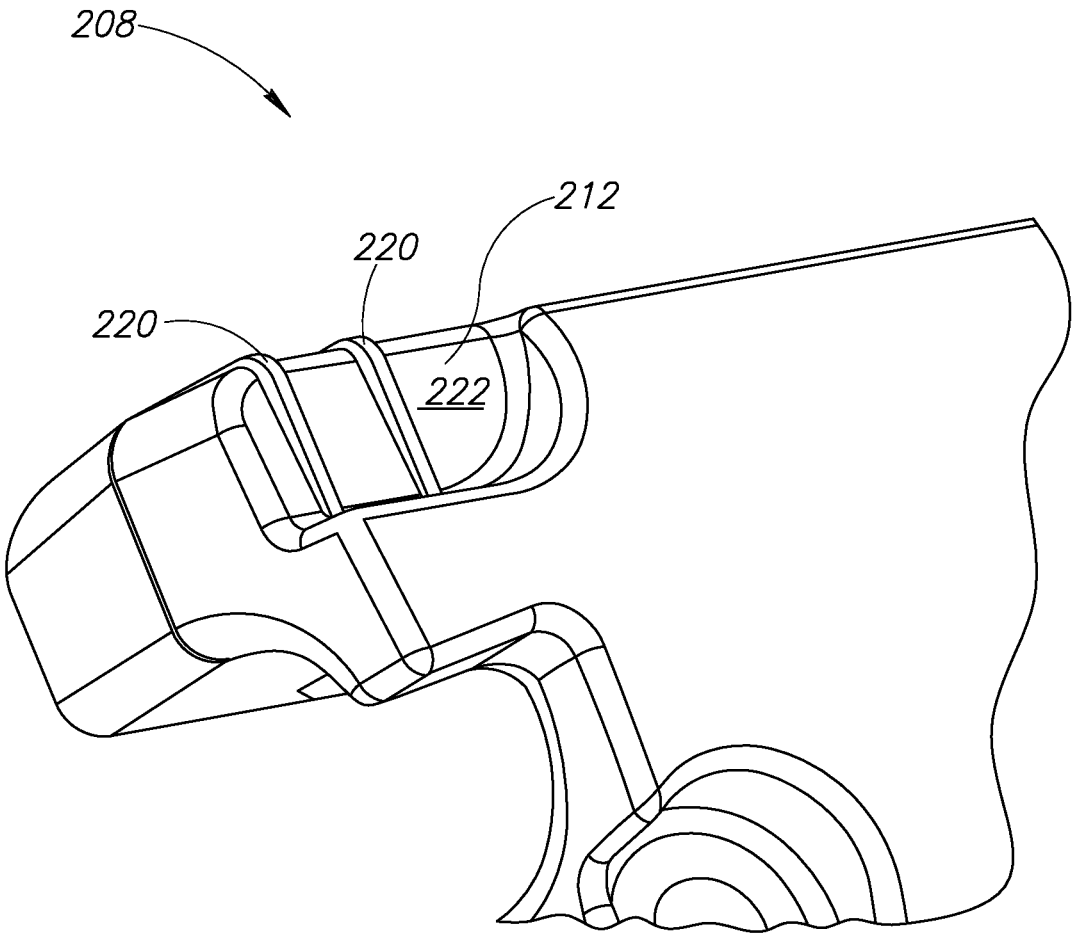
FIG. 11 is a detail, perspective view of a portion of the baseplate of FIG. 10.
Figure 12A:
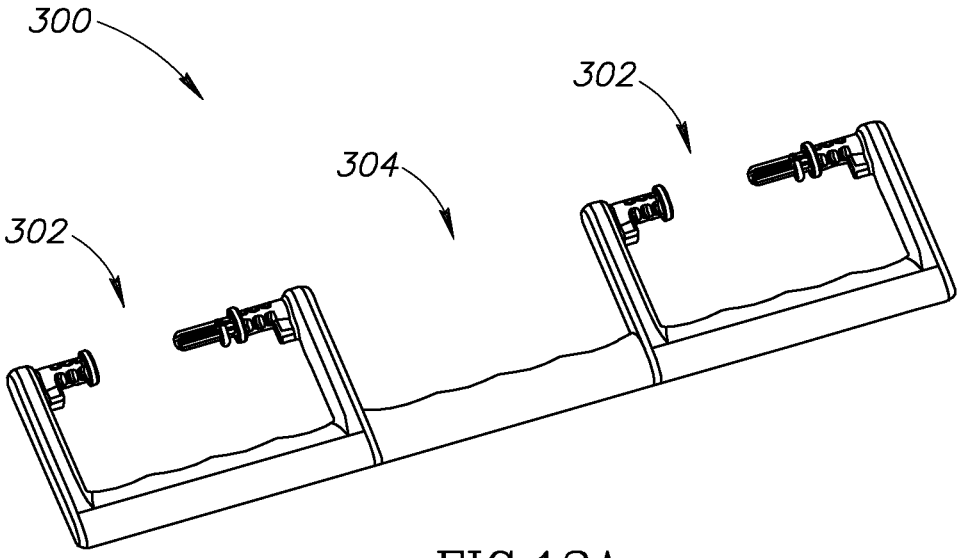
FIG. 12A is a perspective view of a double handle according to an embodiment of the present invention.
Figure 12B:
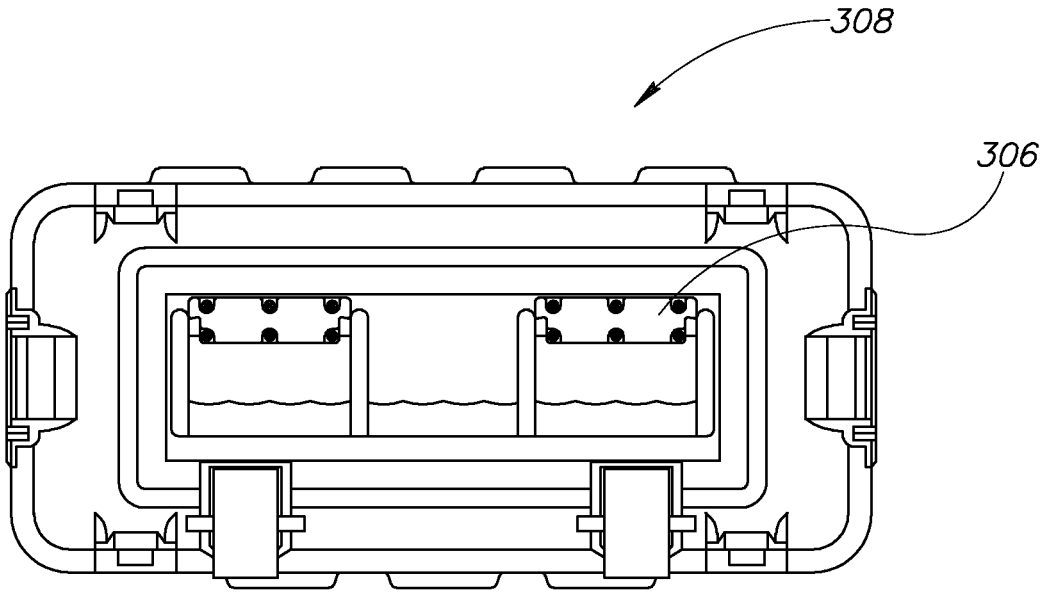
FIG. 12B is a front elevational view of a container having the double handle of FIG. 12A.
Figure 12C:
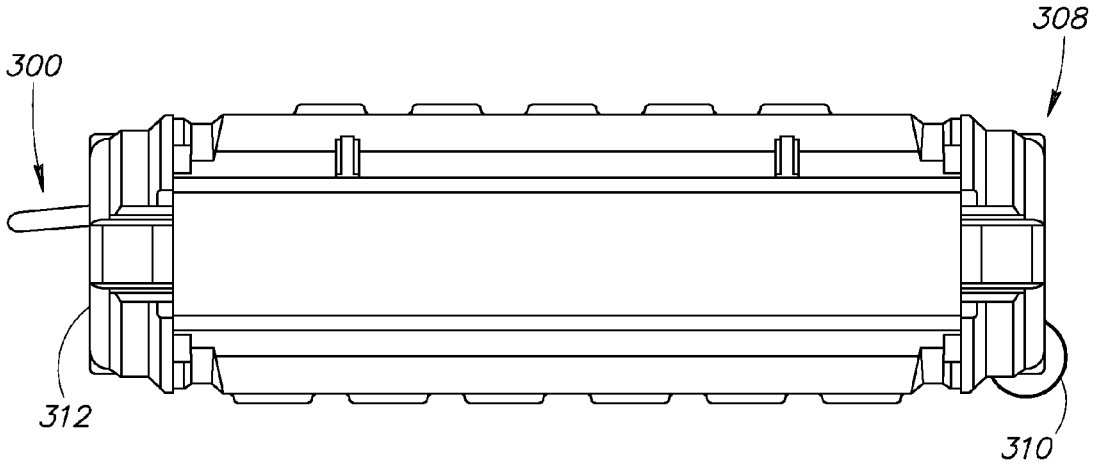
FIG. 12C is side elevational view of the container of FIG. 12B having edge casters and the double handle of FIG. 12A.
Figure 12D:
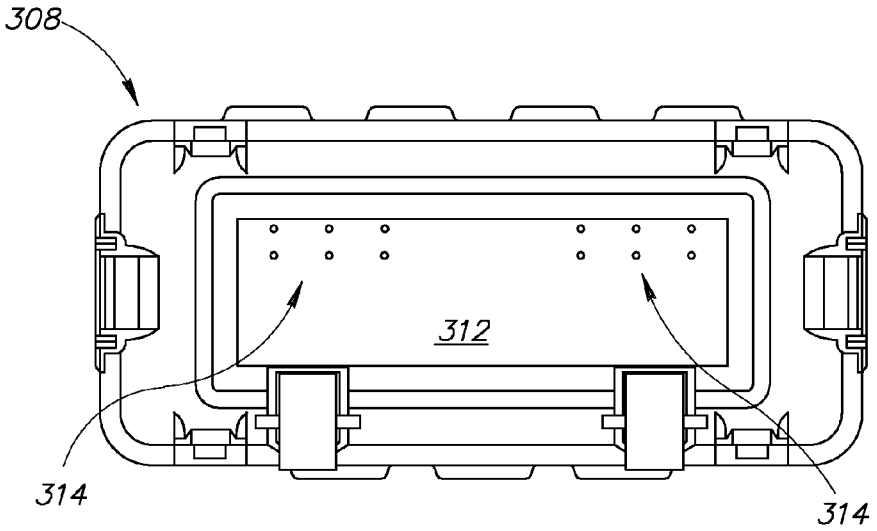
FIG. 12D is a front elevational view of the container of FIG. 12B showing mounting holes for the double handle of FIG. 12A.

FIGS. 10 and 11 show the baseplate 208 with the recessed portions 212 designed and sized to securely fit in the cavity formed by the tabs 210 and container shell 202. When installing the handle assemblies 204, the baseplate 208 is slid up to engage the tabs 210, then the bottom fasteners 218 are installed. In one embodiment, the recessed portions 212 may include ribs 220 extending outward from a surface 222 defining the recessed portion. In a preferred embodiment, the ribs 220 are deformable to accommodate variance in the molded shell dimensions and cause an interference fit by means of rib 220 deformation, or local deformation of overhanging tabs 210 resulting in a secure engagement between the baseplate 208 and shell 202.

FIGS. 12A-12D shows a double handle 300 having two separate handle grips 302 joined together by a center grip 304 to create a single piece with a total of three gripping locations. A baseplate 306, a torsion spring (not shown), a stopping mechanism (not shown), a ramp (not shown), and other components are either identical or substantially similar to the handle assemblies described above. The double handle 300 may be mounted on a container 308 equipped with edge casters 310. When the double handle 300 is mounted on an end 312 opposing the casters, it may be mounted in existing threaded insert locations 314, yet also provide the center grip 304 so the weight of the container 308 may be easier balanced when being toted with one hand.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A handle assembly for a container, the handle assembly comprising:

a handle portion having a grippable member coupled to an arm that extends from the grippable member, the handle portion rotatable about a rotation axis from a stored position to a lifting position;

a first arm stop coupled to a first inboard surface of the handle portion and having a first stop surface and a second arm stop coupled to a second inboard surface of the handle portion and having a second stop surface, the first inboard surface facing the second inboard surface and the first and second stop surfaces being angled relative to the rotation axis, the first and second stop surfaces facing outwardly from one another along the rotation axis; and a baseplate releasably connectable to the handle, the baseplate having a first baseplate stop surface and a second baseplate stop surface, the first and second baseplate stop surfaces being angled relative to the rotation axis and facing inwardly toward one another along the rotation axis, the first baseplate stop surface being arranged to engage with the first stop surface and the second baseplate stop surface being arranged to engage with the second stop surface when the handle portion is rotated to the lifting position having the baseplate stop positioned between the stop surface of the arm stop and the inboard surface of the handle portion such that the first and second baseplate stop surfaces urge the first stop surface and the second stop surface inwardly toward one another along the rotation axis.

2. The handle assembly of claim 1, further comprising:

a post extending from the arm, the post having a first section positioned adjacent the arm and a second section extending from the first section; and a biasing member received on the second section of the post, the member having a first end portion engageable with the baseplate and a second end portion coupled to the post;

wherein the post includes a retaining member configured to ramp the second end of the biasing member into a retaining groove for easier installation.

3. The handle assembly of claim 2, wherein the baseplate being releasably connectable to the handle includes the baseplate having retention protuberances extending from an inner surface of the baseplate, the retention protuberances engageable with the post.

4. The handle assembly of claim 1, wherein the stored position of the handle portion includes the arm being oriented substantially parallel relative to a side surface of the container.

5. The handle assembly of claim 1, wherein the lifting position of the handle portion includes the arm being oriented substantially perpendicular relative to a side surface of the container.

6. The handle assembly of claim 1, further comprising a plurality of fasteners for attaching the baseplate to the container.

7. The handle assembly of claim 2, wherein the biasing member includes a torsional spring that urges the handle portion into the stored position.

8. The handle assembly of claim 2, wherein the baseplate snap fits onto the post.

9. The handle assembly of claim 2, wherein the handle portion rotates about an axis defined by the post.

10. The handle assembly of claim 2, wherein the post is generally cylindrical.

11. A method for lifting a container, the method comprising:

moving a handle portion of a handle assembly from a stored position to a lifting position by rotating the handle portion about an axis of rotation, the handle portion including first and second arms coupled to a baseplate, the first and second arms defining inboard surfaces facing toward one another, each arm defining an arm stop protruding from the inboard surface of the each arm, the arm stops of the first and second arms each including a stop surface, normals of the stop surfaces being angled outwardly from one another;

moving the stop surfaces into engagement with base surfaces secured to the container in response to the moving the handle to the lifting position, normals of the base surfaces being angled inwardly toward one another, the stop surfaces and base surfaces positioned and oriented such that the base surfaces urge the stop surfaces inwardly toward one another responsive to rotation of the handle portion away from the stored position; and biasing the handle portion toward a stored position.

12. The method of claim 11, wherein mechanically stopping the handle portion in the lifting position includes transferring a weight of the container through the stops.

13. The method of claim 11, wherein moving the handle portion from the stored position to the lifting position includes rotating the handle portion about an axis defined by a post of the handle assembly.

14. The method of claim 11, wherein biasing the handle portion toward the stored position includes providing a biasing force from a torsional spring retained on the handle portion and engaged with the baseplate.

15. A container comprising:

a container shell having integral overhanging and undercut tabs having a stop surface facing in an inboard direction; and a handle assembly having a baseplate and a handle portion, the baseplate having an upper portion and a lower portion, the upper portion configured to slide behind and be retained by the tabs, the lower portion attachable to the container shell with a plurality of fasteners, the handle portion having a grippable member coupled to an arm that extends from the grippable member, the handle portion movable from a stored position to a lifting position in which an outboard facing portion of the handle portion contacts the stop surface;

wherein the handle portion includes first and second arms coupled to a baseplate, the first and second arms defining inboard surfaces facing toward one another, each arm defining an arm stop protruding from the inboard surface of the each arm, the arm stops of the first and second arms each including a stop surface, normals of the stop surfaces being angled outwardly from one another;

wherein the baseplate further defines base surfaces secured to the container, normals of the base surfaces angled inwardly toward one another, the stop surfaces and base surfaces positioned and oriented in a lifting position of the handle such that the base surfaces urge the stop surfaces inwardly toward one another responsive to rotation of the handle portion away from a stored position in which the handle portion is closer to the container than in the lifting position.

16. The handle assembly of claim 15, further comprising a post extending inboard from the arm, the post having a first section positioned adjacent the arm and a second section extending from the first section.

17. The handle assembly of claim 16, further comprising a torsional spring received on the second section of the post, the spring having a first end portion engageable with the baseplate and a second end portion retained on the post.

18. The handle assembly of claim 15, wherein the baseplate includes at least one rib sized to provide an interference fit with at least one of the tabs relative to the container.

19. The handle assembly of claim 18, wherein the ribs are deformable.

* * * * *